US008591110B2

(12) United States Patent
Smith et al.

(10) Patent No.: US 8,591,110 B2
(45) Date of Patent: Nov. 26, 2013

(54) BAGS HAVING ADHESIVE DRYING STRUCTURES AND RELATED METHODS

(75) Inventors: Allyson Smith, Columbia, SC (US); Jonathan W. Thompson, Spartanburg, SC (US); Jim Monier, Sibley, IA (US)

(73) Assignee: Exopack, LLC, Spartanburg, SC (US)

( * ) Notice: Subject to any disclaimer, the term of this patent is extended or adjusted under 35 U.S.C. 154(b) by 480 days.

(21) Appl. No.: 12/625,960

(22) Filed: Nov. 25, 2009

(65) Prior Publication Data

US 2011/0123137 A1 May 26, 2011

(51) Int. Cl.
*B65D 30/08* (2006.01)
*B65D 30/12* (2006.01)

(52) U.S. Cl.
USPC ..... 383/116; 383/113; 383/125

(58) Field of Classification Search
USPC ..... 383/125, 126, 120, 113–116; 493/218, 493/219
See application file for complete search history.

(56) References Cited

U.S. PATENT DOCUMENTS

| | | | | | |
|---|---|---|---|---|---|
| 596,373 | A | * | 12/1897 | Lorenz | 383/126 |
| 670,507 | A | * | 3/1901 | Diem | 383/115 |
| 1,903,666 | A | * | 4/1933 | Avery | 383/106 |
| 1,935,380 | A | * | 11/1933 | Smithwick | 493/217 |
| 2,029,340 | A | * | 2/1936 | Royal | 493/188 |
| 2,078,467 | A | * | 4/1937 | Sterling | 383/113 |
| 2,185,469 | A | * | 1/1940 | MacDonald | 229/87.09 |
| 2,312,281 | A | * | 2/1943 | Claspill et al. | 383/114 |
| 2,864,549 | A | * | 12/1958 | Hayward et al. | 383/115 |
| 3,203,622 | A | * | 8/1965 | Fox | 383/98 |
| 3,246,832 | A | * | 4/1966 | Thompson | 383/126 |
| 3,262,633 | A | * | 7/1966 | Leer | 383/126 |
| 3,289,915 | A | * | 12/1966 | Civitello | 383/126 |
| 3,386,646 | A | * | 6/1968 | Hellmuth | 383/115 |
| 3,485,438 | A | * | 12/1969 | McCall et al. | 383/115 |
| 3,622,751 | A | | 11/1971 | Larive et al. | |
| 4,515,840 | A | | 5/1985 | Gatward | |
| 4,861,632 | A | | 8/1989 | Caggiano | |
| 5,032,448 | A | | 7/1991 | Mendenhall | |
| 5,089,075 | A | | 2/1992 | Sonoda | |
| 5,195,829 | A | | 3/1993 | Watkins et al. | |
| 5,244,702 | A | | 9/1993 | Finestone et al. | |
| 5,314,252 | A | | 5/1994 | Happ | |
| 5,376,392 | A | | 12/1994 | Ikegami et al. | |
| 5,472,282 | A | | 12/1995 | Kristola | |
| 5,518,799 | A | | 5/1996 | Finestone et al. | |
| 5,520,464 | A | | 5/1996 | Kristola | |

(Continued)

FOREIGN PATENT DOCUMENTS

| | | | |
|---|---|---|---|
| JP | 56-138049 | U | 10/1981 |
| JP | 11-342953 | A | 12/1999 |
| WO | WO 2011/066297 | | 6/2011 |

OTHER PUBLICATIONS

International Search Report and Written Opinion dated Aug. 31, 2011 in International Application No. PCT/US2010/057828, now published as WO 2011/066297.

*Primary Examiner* — Jes F Pascua
(74) *Attorney, Agent, or Firm* — Stoel Rives LLP

(57) ABSTRACT

A bag can be formed of a material having a layer that is substantially water-impervious. A portion of the material can be folded to form a base of the bag. Water-based adhesives can be used with the folded portions to form the base, and openings can be provided in the layer of the material to permit the adhesives to dry.

65 Claims, 8 Drawing Sheets

(56) References Cited

U.S. PATENT DOCUMENTS

| | | | | |
|---|---|---|---|---|
| 5,590,777 | A | 1/1997 | Weiss et al. | |
| 5,677,032 | A | 10/1997 | Anwyll, Jr. | |
| 5,786,064 | A | 7/1998 | Finestone et al. | |
| 5,811,161 | A | 9/1998 | Jöves et al. | |
| 5,871,790 | A | 2/1999 | Monier et al. | |
| 5,994,685 | A | 11/1999 | Jackson et al. | |
| 6,003,670 | A * | 12/1999 | Beer | 206/459.5 |
| 6,033,114 | A | 3/2000 | Grimm et al. | |
| 6,170,985 | B1 | 1/2001 | Shabram, Jr. et al. | |
| 6,187,396 | B1 | 2/2001 | Möller | |
| 6,213,642 | B1 | 4/2001 | Jensen | |
| 6,338,572 | B1 | 1/2002 | Schneck | |
| 6,491,433 | B2 | 12/2002 | Shabram, Jr. et al. | |
| 6,652,145 | B2 | 11/2003 | Valdez | |
| 6,797,395 | B2 | 9/2004 | Finestone et al. | |
| 6,883,964 | B2 | 4/2005 | Beaulieu | |
| 7,128,704 | B2 | 10/2006 | Colgan | |
| 7,175,583 | B2 | 2/2007 | Su | |
| 7,332,052 | B2 | 2/2008 | Colgan | |
| 2002/0110675 | A1 | 8/2002 | Finestone et al. | |
| 2002/0146520 | A1 | 10/2002 | Squier et al. | |
| 2003/0156767 | A1 | 8/2003 | Valdez | |
| 2003/0179960 | A1 | 9/2003 | Beaulieu | |
| 2004/0105993 | A1 | 6/2004 | Finestone et al. | |
| 2004/0157051 | A1 | 8/2004 | Trent et al. | |
| 2005/0014431 | A1 | 1/2005 | Carmody | |
| 2005/0181923 | A1 | 8/2005 | Su | |
| 2008/0273820 | A1 | 11/2008 | Wiker et al. | |

* cited by examiner

BAGS HAVING ADHESIVE DRYING STRUCTURES AND RELATED METHODS

TECHNICAL FIELD

The present disclosure relates to bags having at least one sealed end that may, in some cases, be used in the packaging industry, as well as methods for forming the bags.

SUMMARY

Embodiments of bags having at least one sealed end, as well as related systems and methods, are disclosed.

DETAILED DESCRIPTION

Figure 1:
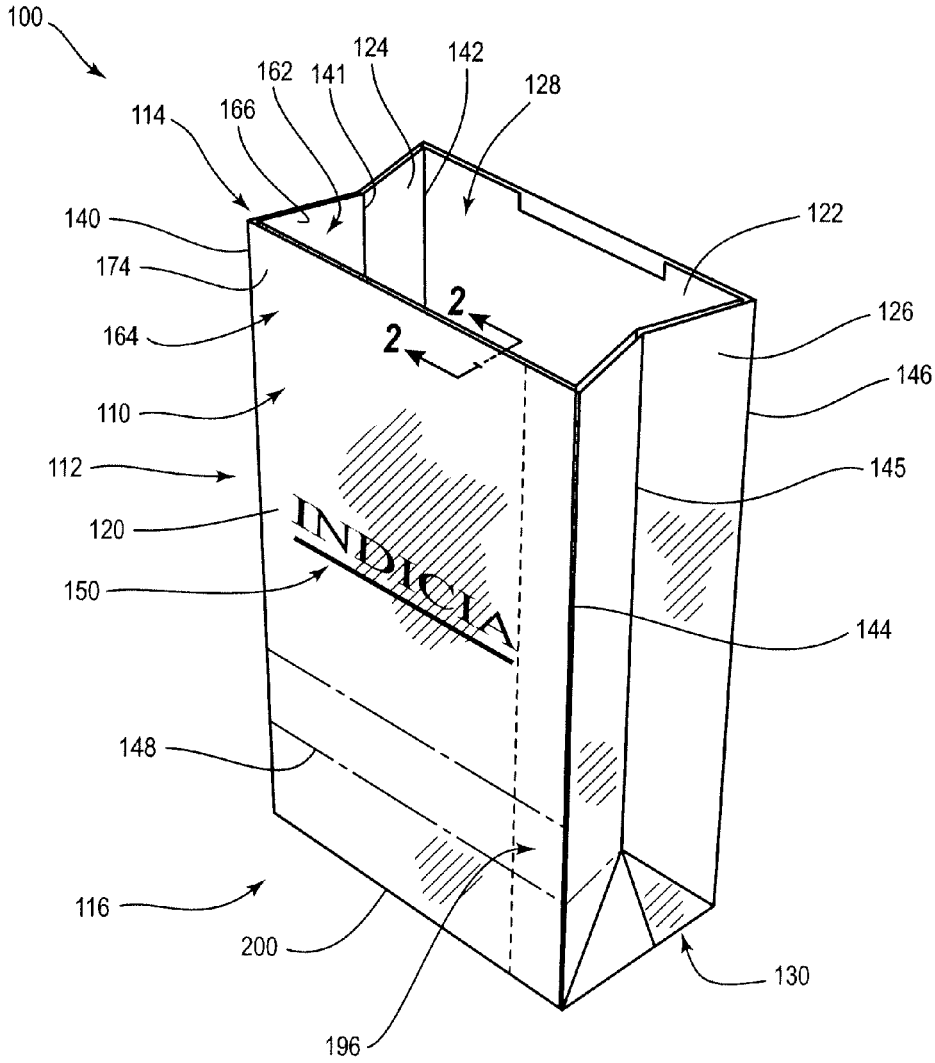
FIG. 1 is a perspective view of an embodiment of a bag formed from an embodiment of a body material that includes an inner ply and an outer ply.

Traditional self-opening style bags, or "SOS" bags, are commonly used for such applications as grocery sacks, lunch sacks, etc. These bags are generally formed from a paper ply (e.g., a ply of Kraft paper) having a base portion that is folded into a substantially planar configuration. The bags thus can readily stand upright on their base. An adhesive can be applied between different surfaces of folded portions that form the base such that the base is in a closed state. In some cases, water-based adhesives can be used in formation of the base.

Other SOS bag varieties are also known. In particular, heat-seal SOS bags have been developed for use with such products as pet foods and chemicals. Heat-seal SOS bags can include a heat sealable material located at specific regions of a bottom end of the bag or may cover an entire interior surface of the bag. The processes for creating a substantially planar surface for heat-seal SOS bags can be different from those used for the traditional SOS bags. For example, in some cases, bottom extensions from the side walls of the heat-seal SOS bags are folded inward such that interior surfaces thereof contact each other and are heat sealed to each other, a bottom extension of the front wall is then adhered to an outer surface of the heat sealed side wall extensions, and a bottom extension of the rear wall is then adhered to the folded extension of the front wall. In some cases, the heat-seal SOS bags have a polyester film as an outermost layer, which can be substantially impervious to water. In such cases, hot melt adhesives, rather than water-based adhesives, are generally used to adhere the front wall extension to the side wall extensions and to adhere the rear wall extension to the front wall extension.

Heat-seal SOS bags can be more expensive to manufacture than traditional SOS bags. For example, in some cases, the interior layer of heat sealable material can add cost to the bags. Similarly, application and activation of hot melt adhesives can complicate the assembly procedure, and the hot melt adhesives can be more expensive than certain water-based adhesives. Moreover, different equipment for forming and sealing the heat-seal SOS bags can be required.

Certain embodiments described herein can eliminate one or more of the foregoing issues related to heat-seal SOS bags, and can be suitable for the same uses as heat-seal SOS bags. For example, in some embodiments, the SOS bags are formed on standard equipment used for constructing traditional SOS bags. The SOS bags can have an outermost layer that can be substantially impervious to water, such as, for example, a polyolefin layer. The SOS bags can include permeable regions within the outermost layer that comprise openings through which water can pass. The permeable regions can be located in the folded lower ends of the bags, and can allow water-based adhesives that are applied to the lower ends to dry and properly seal the bag ends.

Some embodiments can omit the use of heat seals in the lower end of the bags. Accordingly, in some embodiments, an inner heat-sealable lining can be omitted or replaced with a different lining material (such as, for example, biaxially oriented polypropylene (BOPP)).

As further discussed below, other embodiments are also possible, and may include one or more features of heat-seal SOS bags. For example, heat-seal SOS bags can include a standard heat seal, but can be modified to use water-based adhesives in the place of hot melt adhesives. Moreover, although the disclosure focuses on examples relative to SOS bags, certain features, apparatus, and methods disclosed herein can be applied suitably to other bag formats. Accordingly, the present disclosure is not limited to SOS bag formats, and can apply to other packaging formats (e.g., flexible packaging formats, in general).

FIG. 1 illustrates an embodiment of a bag 100 that generally defines an SOS configuration. The bag 100 comprises a body material 110 that has been folded to form a tube 112 having an open top end 114 and a closed bottom end 116. In the illustrated embodiment, the tube 112 is defined by a front wall 120, a rear wall 122, a left side wall 124, and a right side wall 126. The walls 120, 122, 124, 126 may also be referred to as faces. Each of the left and right side walls 124, 126 can extend between the front and rear walls 120, 122. The walls 120, 122, 124, 126 cooperate to define a bag cavity 128 into which a product can be received.

As further discussed below, one or more panels can depend from a bottom end of each of the walls 120, 122, 124, 126. The one or more panels can be folded inward (e.g., towards an interior of the tube 112) to define a base 130. The base 130 can be substantially planar such that the bag 100 is able to stand upright on the base 130 when the tube 112 is in an expanded configuration. Each of FIGS. 1, 5, 6, and 8 provide examples of the tube 112 in an expanded configuration.

Although not shown, it will readily be understood that the tube 112 can be positioned in a collapsed state in which the front wall 120 is approximated to the rear wall 122. For example, the tube 112 can be folded along a left front fold line 140, a left medial fold line 141, a left rear fold line 142, a right front fold line 144, a right medial fold line 145, and a right rear fold line 146 to place the front wall 120 and the rear wall 122 in close proximity to each other. The left fold lines 140, 141, 142 and the right fold lines 144, 145, 146 thus can provide the left side wall 124 and the right side wall 126, respectively, with gusseted structures. The tube 112 can further be folded along a base fold line 148 to place the plane of the base 130 at only a slight angle relative to a plane defined by an upper region of the front wall 120.

As used herein, terms describing orientation, such as front, back, left, right, etc., are recited from the perspective illustrated in FIG. 1. Such directional terms are used for convenience and should not be construed as limiting. For example, in some embodiments, the front wall 120 may in fact be printed with material generally relegated to the back of a package, whereas the rear wall 122 may be printed with material generally displayed on the front of a package. In the illustrated embodiment, the bag 100 includes printed indicia 150 visible from a position exterior to the bag 100. In various embodiments, the printed indicia 150 can be included on one or more of the walls 120, 122, 124, 126. An orientation of the bag 100 can be determined relative to the orientation and content of the printed indicia 150.

Figure 2:
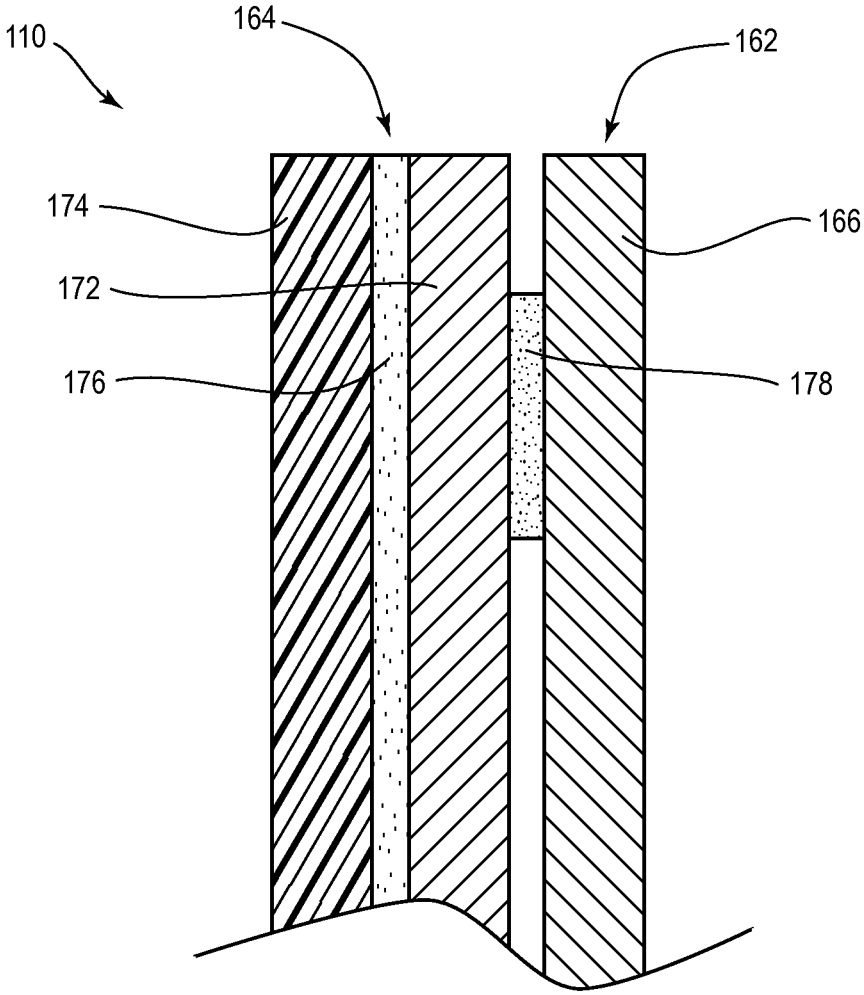
FIG. 2 is a cross-sectional view of a portion of the bag of FIG. 1 taken along the view line 2-2 in FIG. 1.

With reference to FIGS. 1 and 2, in certain embodiments, the body material 110 can include multiple plies. For example, the illustrated embodiment of the body material 110 includes an inner ply 162 and an outer ply 164. The inner ply 162 comprises a layer of paper 166. The paper layer 166 can comprise any suitable paper known in the art or yet to be devised. For example, in some embodiments, the paper layer 166 comprises Kraft paper of any suitable basis weight. In some embodiments, the Kraft paper can be chemically treated so as to be grease-resistant.

In further embodiments, the inner ply 162 comprises a substantially grease-proof layer (not shown). For example, one or more layers of one or more of biaxially oriented polypropylene (BOPP) or a high density polyethylene film, can be laminated to an inner surface of the paper layer 166. In other or further embodiments, the body material 110 can include one or more additional paper plies.

In other or further embodiments, the inner ply 162 can comprise one or more layers of one or more other or additional materials. In some embodiments, it can be desirable for the material or materials of the inner ply 162 to provide the bag 100 with strength and rigidity, although in certain embodiments, these features can be provided primarily by the outer ply 164. As will be evident from further discussion below, it can be desirable for one or more materials of the inner ply 162 to transmit, channel, conduct, or otherwise permit the passage or escape of water or other solvents within or through them. For example, materials that can absorb, soak up, disperse, or otherwise move or permit passage or escape of water within or through them in a manner similar to paper can be desirable. As used above and elsewhere herein, the term "water" can apply to water in one or more of the liquid and gaseous states. Accordingly, a material that is permeable to water can permit passage through it of one or more of liquid water and water vapor. In some embodiments, the inner ply 162 comprises a water-permeable (or, more generally, a solvent-permeable) material.

The outer ply 164 can include a paper layer 172, which can comprise any suitable paper known in the art or yet to be devised, including, but not limited to, coated or uncoated, bleached or non-bleached, treated or non-treated paper. In some embodiments, the outer paper layer 172 is substantially the same as the inner paper layer 166, whereas in other embodiments, one or more properties of the outer and inner paper layers 172, 166 differ from each other. In some embodiments, the paper layer 172 comprises a bleached, clay coated paper that may be well-suited for printing. In certain of such embodiments, the indicia 150 can be printed directly on an outer surface of the paper layer 172.

The outer ply 164 can include an outer layer 174, which can be laminated to the paper layer 172 in any suitable manner. For example, in some embodiments, the outer layer 174 is joined to the paper layer 172 via a suitable tie layer or adhesive 176. The outer layer 174 can be substantially water-impervious (e.g., can comprise a substantially water-impervious material) such that water cannot easily pass through it, or cannot pass through it at all under normal conditions (e.g., room temperature and atmospheric pressure). In some embodiments, the outer layer 174 comprises one or more polyolefins and/or one or more polyamides. For example, in various embodiments, the outer layer 174 comprises one or more of a polyester film, a polyethylene terephalate (PET) film, and one or more films of one or more other materials, including, but not limited to, polypropylene or nylon.

In some embodiments, the outer layer 174 is transparent or translucent. In further embodiments, at least a portion of the outer layer 174 is reverse printed. The outer layer 174 need not be the outermost layer of the body material 100, or more generally, of the bag 100. For example, in some embodiments, one or more additional layers are positioned outside of the outer layer 174, such as any suitable clear and/or abrasion-resistant coating.

In some embodiments, the inner and outer plies 162, 164 are attached to each other. The inner and outer plies 162, 164 can be joined in any suitable manner. For example, in some embodiments, the plies 162, 164 are laminated to each other such that substantially all of an interior surface of the outer paper layer 172 is adhered to an outer surface of the inner paper layer 166. In the illustrated embodiment, an adhesive 178 joins only a portion of the inner ply 162 to a portion of the outer ply 164 (e.g., the inner and outer plies 162, 164 are spot pasted to each other). Other portions of the inner and outer plies 162, 164 that are not adhered to each other can be permitted to shift relative to one another. In other embodiments, the inner ply 162 can be omitted. For example, the body material 110 can comprise only the outer ply 164.

Figure 3:
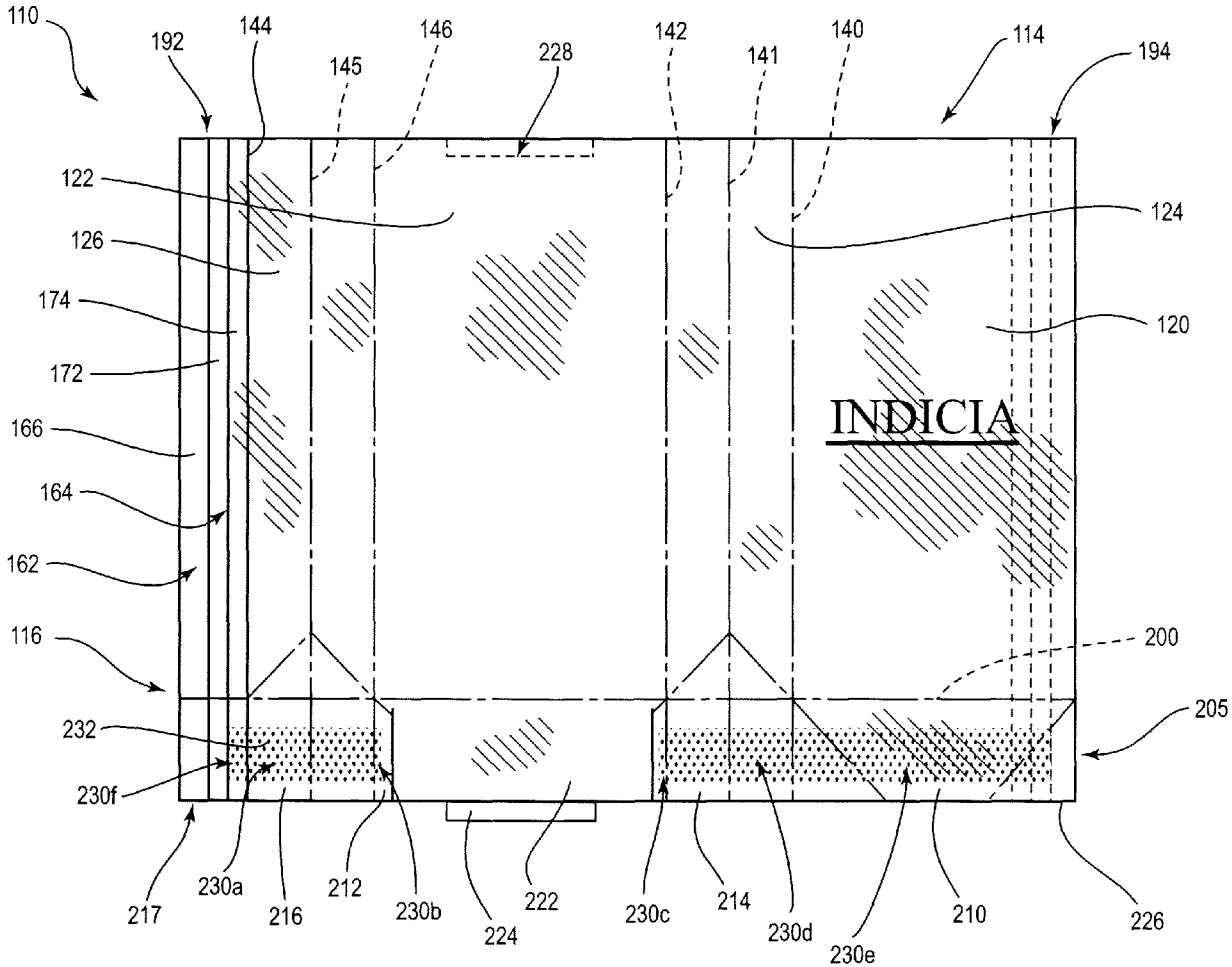
FIG. 3 is a plan view of an outward-facing surface of an embodiment of a body material that can be formed into the bag of FIG. 1.
Figure 4:
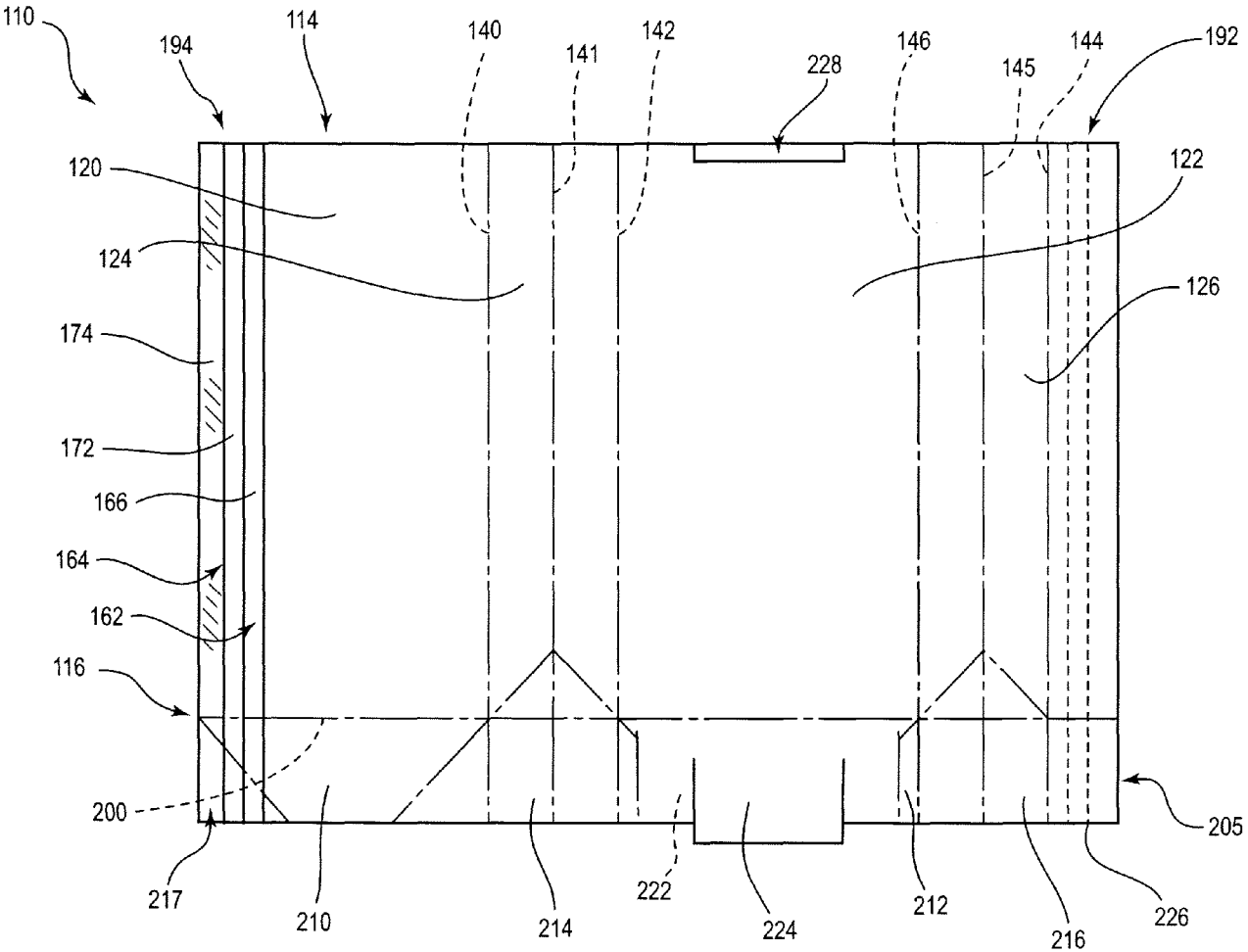
FIG. 4 is a plan view of an inward-facing surface of the body material of FIG. 3.

FIGS. 3 and 4 illustrate plan views of an exterior surface and an interior surface, respectively, of the body material 110 before it is formed into the bag 100. The portions of the body material 110 that form the walls 120, 122, 124, 126 are identified, as are the left fold lines 140, 141, 142 and the right fold lines 144, 145, 146. Likewise, the inner paper layer 166, the outer paper layer 172, and the outer layer 174 are identified. In the illustrated embodiment, each of the layers 166, 172, 174 are substantially the same size (i.e., define substantially the same area), but are offset from one another in a lateral direction to form an inner salvage edge region 192 and an outer salvage edge region 194. The salvage edge regions 192, 194 can be joined to each other in any suitable fashion at a seam 196, which is shown in FIG. 1. However, in the illustrated embodiment, each of the layers 166, 172, 174 are substantially coextensive with each other in a longitudinal direction such that at least a portion of each layer 166, 172, 174 extends between an upper edge (e.g., the upper end 114) and a terminal edge 226 of the body material 110.

As shown in each of FIGS. 1, 3, and 4, the walls 120, 122, 124, 126 can extend from the top end 114 of the tube 112 to the bottom end 116, which can define a bottom edge 200. With continued reference to FIGS. 3 and 4, an extension panel 205 can depend from the bottom edge 200. In the illustrated embodiment, the extension panel 205 depends from the bottom edge 200 of each of the wall portions 120, 122, 124, 126 of the body material 110. In particular, the extension panel 205 includes a plurality of sub-panels depending from each specific wall portion 120, 122, 124, 126 downwardly and along and between the fold lines 140, 142, 144, 146. The extension panel 205 thus can include a front extension panel or sub-panel 210 depending from the front wall 120, a rear extension panel or sub-panel 212 depending from the rear wall 122, a left side extension panel or sub-panel 214 depending from the left side wall 124, and a right side extension panel or sub-panel 216 depending from the right side wall 126. In the illustrated embodiment, the extension sub-panels 210, 212, 214, 216 extend continuously from one side end of the extension panel 205 to the other (i.e., none of the contiguous sub-panels are separated from each other, such as by slits). Other configurations of the extension panel 205 are also possible; for example, in some embodiments, slits can separate the extension sub-panels 210, 212, 214, 216 from each other.

In the illustrated embodiment, the rear extension sub-panel 212 includes an outer flap 222 and an inner flap 224, which can be unattached to each other. The outer flap 222 is defined by the outer ply 164 and the inner flap 224 is defined by the inner ply 162. The inner flap 224 can extend downwardly beyond the terminal edge 226 of the extension panel 205. Because multiple inner plies 162 can be cut from the same sheet of material, an upper end of the rear panel 122 can include a notch 228 having a shape complementary to a lower region of the inner flap 224. Other embodiments can be devoid of an inner flap 224, such that a terminal edge of the inner ply 162 of the rear extension sub-panel 212 is coextensive with the terminal edge 226 of the body material 110; likewise, an upper edge of the inner ply 162 of the rear panel 122 can be coextensive with the upper end 114 of the body material 110.

With reference to FIG. 3, the extension panel 205 can include one or more permeable regions 230. In the illustrated embodiment, the right side extension sub-panel 216 includes a permeable region 230*a*, the rear extension sub-panel 212 includes two small permeable regions 230*b*, 230*c* that are separated from each other by the flap 222, which itself can be substantially impermeable, the left side extension sub-panel 214 includes a permeable region 230*d*, and the front extension sub-panel 210 includes a permeable region 230*e*. Likewise, the inner salvage edge region 192 can define a panel or sub-panel portion 217 of the panel 205 that includes a permeable region 230*f*.

Various configurations of the permeable regions 230 are possible. For example, in some embodiments, the permeable regions 230 can be constrained to the extension panel 205. For example, the permeable regions 230 may exist in only one or more of the sub-panels 210, 212, 214, 216. In other or further embodiments, a permeable region 230 covers all or substantially all of the extension panel 205. In other embodiments, such as the illustrated embodiment, one or more permeable regions 230 cover only a portion of the extension panel 205. For example, in various embodiments, no more than about ⅛, no more than about ⅙, no more than about ¼, no more than about ⅓, no more than about ½, no more than about ⅔, or no more than about ¾ of the total area of the extension panel 205 comprises one or more permeable regions 230. Moreover, the one or more permeable regions 230 can extend only a portion of the distance between the terminal edge 226 of the extension panel 205 and the bottom edge 200 of the walls 120, 122, 124, 126. For example, in various embodiments, one or more permeable regions 230 extend between the bottom edge 200 and the terminal edge 226 by a distance that is no less than about ¼, no less than about ⅓, no less than about ½, no less than about ⅔, or no less than about ¾ the total distance between the bottom edge 200 and the terminal edge 226. In the illustrated embodiment, the permeable regions 230 extend between the bottom edge 200 and the terminal edge 226 by a distance that is about ½ the total distance between the bottom edge 200 and the terminal edge 226.

Similarly, a permeable region 230 may extend along some or all of a transverse width of a given sub-panel. In the illustrated embodiment, the permeable regions 230*a* and 230*d* extend along the full width of the sub-panels 216, 214, respectively. In contrast, the permeable region 230*e* terminates short of extending the full width of the sub-panel 210; it extends only about 90 percent of the width of the sub-panel 210. The end portion of the sub-panel 210 that is devoid of the permeable region 230*e* can be sized to overlap the permeable region 230*f* of the salvage edge region 192, which can aid in forming the seam 196, as discussed further below.

Although substantially rectangular permeable regions 230 are shown in the illustrated embodiment, other configurations (e.g., outlines or shapes) are possible. Likewise, one or more of the rectangular permeable regions 230 can have larger or smaller heights or widths than the other permeable regions 230. Any suitable configuration of the permeable regions consistent with the disclosure herein is possible.

Each permeable region 230 can include one or more openings 232 through the outer layer 174 of the body material 110. As discussed above, the outer layer 174 can comprise a substantially water-impervious material. Accordingly, the size of the openings 232 can be sufficient to permit the passage of water, which can aid in drying an adhesive (such as a water-based adhesive) disposed on the permeable region 230. In some embodiments, the one or more openings 232 are relatively large such that not only water (e.g., water vapor or liquid water) can pass through them, but also at least a portion of the adhesive. For example, in some embodiments, the openings 232 are formed via die cutters or relatively large pin perforators. In various embodiments, one or more openings 232 have a maximum width (e.g., a maximum transverse dimension measured in a direction substantially parallel to a plane defined by an extension panel) of no less than about 1/32 of an inch, no less than about 1/16 of an inch, no less than about ⅛ of an inch, or no less than about ¼ of an inch.

In other or further embodiments, the openings 232 can be relatively small such that the adhesive is substantially prevented from passing through the openings, yet water is permitted to pass. For example, in some embodiments, the openings comprise micro-perforations. The small openings may be capable of wicking the water or drawing the water from the adhesive via capillary action, or otherwise serving as a corridor for egress of water to allow the adhesive to dry. In some embodiments, wicking by a relatively small opening 232 may be enhanced when the opening 232 is in close proximity to one or more paper layers, as the paper layers may themselves be capable of capillary action or otherwise be configured to efficiently absorb or disperse water. In various embodiments, one of more openings 232 have a maximum width of no more than about 1/64 of an inch, no more than about 1/48 of an inch, no more than about 1/32 of an inch, or no more than about 1/16 of an inch. In certain embodiments, one or more permeable regions may appropriately be termed as venting regions as water vapor may be more easily transmitted through them than liquid water.

In certain embodiments, the one or more openings 232 can extend through a full thickness of only the outer layer 174. For example, in some embodiments, the openings 232 are formed in the outer layer 174 prior to laminating the outer layer 174 to the outer paper layer 172. In other embodiments, the one or more openings 232 can extend through a full thickness of the outer ply 164 (e.g., through both the outer layer 174 and the outer paper layer 172). For example, the outer layer 174 and the outer paper layer 172 can be laminated to each other prior to formation of the openings 232. In still other embodiments, the one or more openings 232 can extend through a full thickness of the body material 110 (e.g., through both the inner ply 162 and the outer ply 164).

The depth and/or width (see discussion above) of the openings 232 can be varied or selected depending on the application of the bag 100. For example, in some embodiments, the bag 100 may be used to store a product for which oil- or grease-resistance is not an issue. In certain of such embodiments, the bag 100 might include relatively large openings 232 and/or openings 232 that extend through the full thickness of the body material 110. The adhesive applied to the permeable regions in which the openings 232 are disposed may provide a sufficient barrier for the openings 232.

In other embodiments, the bag 100 may be used to store a product having an oil or grease content that would make oil- or grease-resistance in a bottom closure desirable. In certain of such embodiments, the openings 232 may be relatively small (e.g., perforations or micro-perforations) and/or may extend through only a portion of the thickness of the body material 110 (e.g., through the outer layer 174 and/or the outer paper layer 172).

The openings 232 can have any suitable cross section, that provides for the evaporation of moisture. For example, the openings 232 can be substantially oval, circular, diamond-shaped, rectangular, square, etc. Moreover, a plurality of openings 232 can be arranged in any suitable manner within a permeable region 230. For example, in the illustrated embodiment, the openings 232 are spaced at regular intervals in a repeating pattern within the permeable regions. In various embodiments, the spacing between adjacent openings 232 can be no less than about 2 times a maximum width of the openings 232, no less than about 5 times a maximum width of the openings 232, no less than about 10 times a maximum width of the openings 232, no less than about 20 times a maximum width of the openings 232, or no less than about 30 times a maximum width of the openings 232. The size and spacing of the openings 232 can be adjusted, in some embodiments, to achieve a desired rate of drying of an adhesive disposed on (or within) the openings 232.

Figure 5:
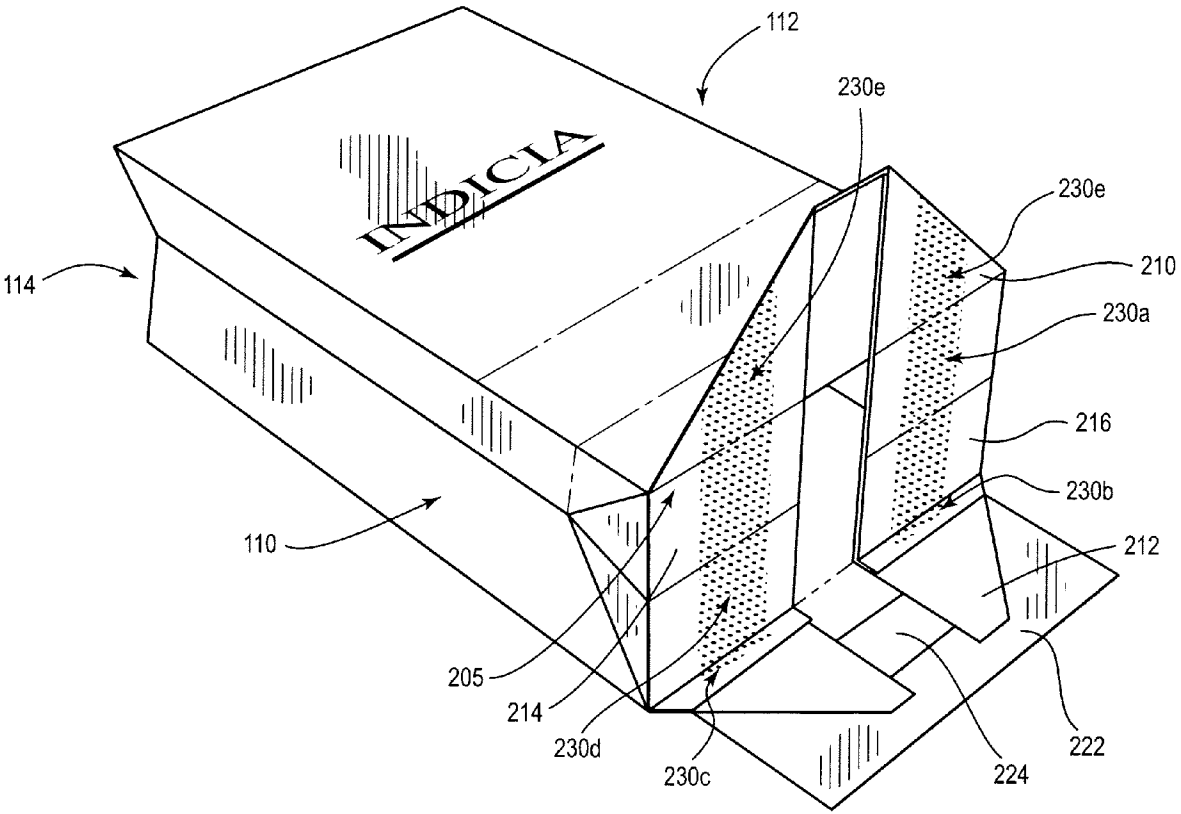
FIG. 5 is a perspective view of the body material of FIG. 3 in a stage of bag formation.

FIG. 5 illustrates a stage of assembly of the body material 110 into an embodiment of a bag 100. Portions of the extension panel 205 have been folded inward, or toward an interior of the tube 112. In particular, the left and right side extension panels 214, 216 have been folded inward, whereas the front and rear extension panels 210, 212 have not, or at least not completely. Each of the permeable regions 230*a*, 230*b*, 230*c*, and 230*d* is shown, as is a portion of the permeable region 230*e*. Due to the folding of the left and right side extension panels 214, 216, the permeable regions 230*a*, 230*d* face downward, or away from the top end 114 of the tube 112.

In the illustrated embodiment, the inner flap 224 has been folded inward such that an inner surface thereof faces itself. The outer flap 222, in contrast, remains fully extended. Folding the inner flap 224 in the manner just described can take place prior to folding the left and right side extension panels 214, 216.

Figure 6:
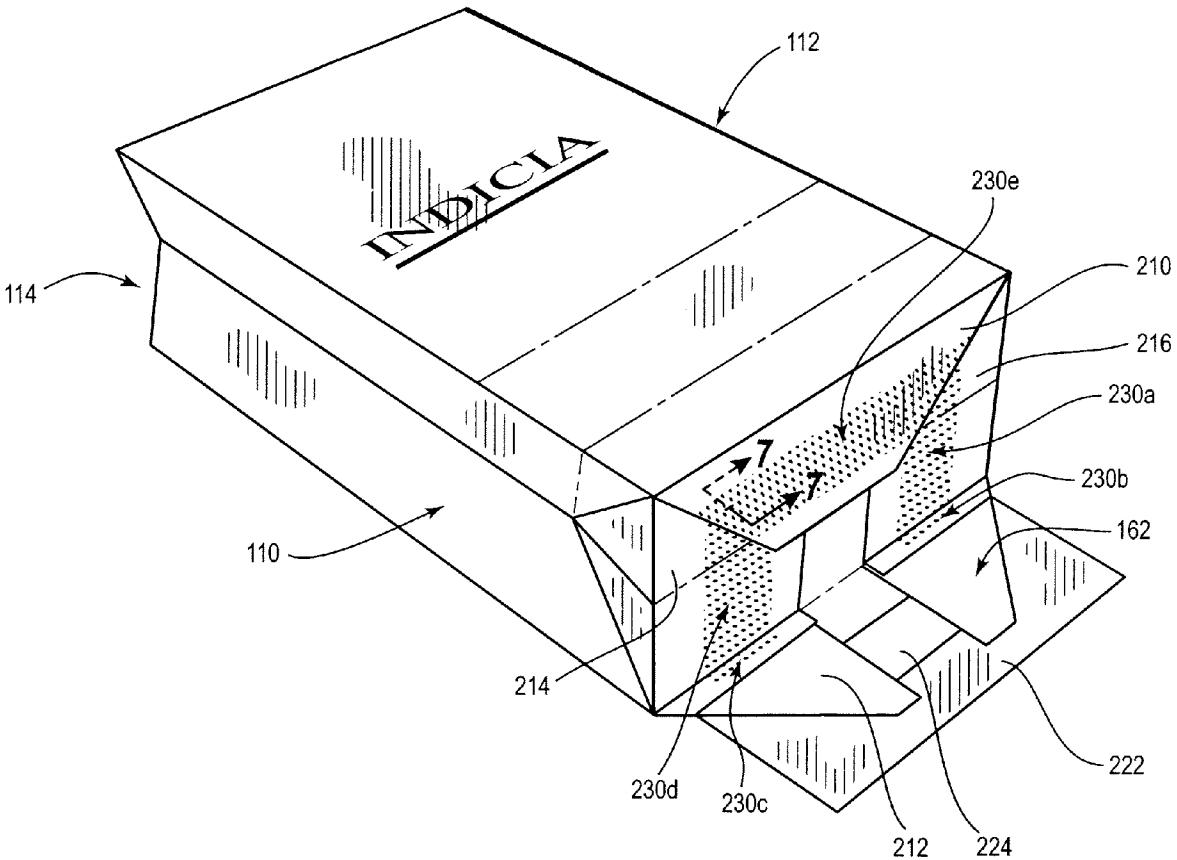
FIG. 6 is a perspective view of the body material of FIG. 3 in a further stage of bag formation.
Figure 7:
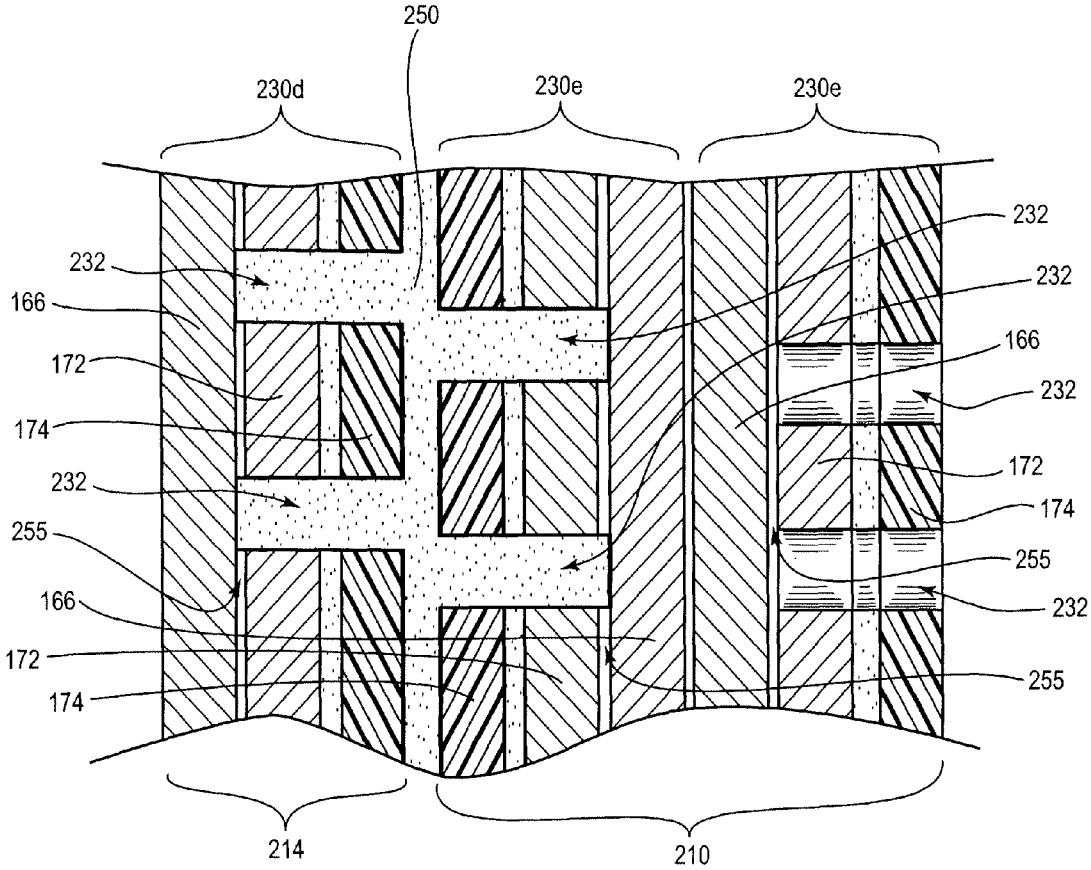
FIG. 7 is a cross-sectional view of a portion of the body material of FIG. 3, which has been partially formed into a bag, taken along the view line 7-7 in FIG. 6.

With reference to FIGS. 6 and 7, in a subsequent stage of assembly, an adhesive 250 is provided to an outer surface of one or more of the outer layers 174 of the left side extension sub-panel 214 and the front extension sub-panel 210. Similarly, the adhesive 250 can be provided to an outer surface of one or more of the outer layers 174 of the right side extension sub-panel 216 and the front extension sub-panel 210. The front extension sub-panel 210 can then be folded inwardly such that the adhesive 250 is between the front extension sub-panel 210 and each of the left and right side extension panels 214, 216. Stated otherwise, the front extension sub-panel 210 can be folded, so as to direct a portion of the permeable region 230*e* thereof toward the upper end 114 of the tube 112.

In the embodiment illustrated in FIG. 7, the openings 232 are sufficiently large to permit the adhesive 250 to be received therein. The adhesive 250 can contact the outer paper layer 172 portion of each of the left side extension sub-panel 214 and the front extension sub-panel 210, and can further contact the inner paper layer 166 portion of each of these extension panels 214, 210. As previously discussed, this contact can aid in drying the adhesive 250. Because different portions of the paper layer 166 are in direct contact with the adhesive 250, it can be said that these portions of the paper layer 166 are directly adhered to one another via the adhesive 250. In other embodiments, the openings 232 may be smaller such that the adhesive does not contact one or more of the paper layers 166, 172, but the openings 232 may still be suitable for drying the adhesive 250 (as previously discussed).

In some embodiments, one or more of the paper layers 166, 172 may be able to transmit moisture absorbed from the adhesive 250 to outer edges of the paper layers 166, 172 that are exposed to surrounding air (e.g., outer edges that are not covered by a laminant), which can aid in the drying. In other or further embodiments, the paper layers 166, 172 can define one or more passageways air passages 255 between them. The passageways 255 can result from adhering only a portion of the paper layers 166, 172 to each other, such as, for example, via the arrangement depicted in FIG. 2 (e.g., spot pasting). The passageways 255 can provide a further channel or egress path for moisture away from the adhesive 250. The passageways 255 can be exposed to outside air, or air external to the bag 100.

In the illustrated embodiment, the permeable region 230*d* and a portion of the permeable region 230*e* contact the adhesive 250. Accordingly, moisture can be removed from the adhesive 250 via one or more of the paper layers 166, 172 and/or the passageways 255 of the left side extension sub-panel 214, as well as one or more of the paper layers 166, 172 and/or the passageways 255 of the front extension sub-panel 210. However, in other embodiments, one or the other of the extension panels 210, 214 may be devoid of a permeable region 230*d*, 230*e*. In certain of such embodiments, a single permeable region 230*d* or 230*e* can sufficiently dry the adhesive 250.

In various embodiments, the adhesive 250 can comprise any suitable water-based adhesive known in the art or yet to be devised. In some embodiments, it can be desirable for the adhesive 250 to adhere well to the material or materials of which the outer layer 174 is formed. For example, it can be desirable for the adhesive 250 to form strong bonds with a polyolefin, such as, for example, polyester. In other embodiments, such as when different portions of the paper layer 166 are directly adhered to each other via the adhesive 250 and the openings 232 (as described above), it can be sufficient for a strong bond to be formed with the paper layers 166, independent of the strength of the bond between the adhesive 250 and the outer layer 174.

A variety of suitable adhesives 250 are available. For example, adhesives commercially available from H.B. Fuller of Saint Paul, Minn. may be used, including one or more of item numbers 4784 and WB 8060, and/or adhesives commercially available from Henkel Corporation, New Jersey may be used, including one or more of item numbers 9020 and 33-4057. In addition to water-based adhesives, other suitable adhesives may include starch-based adhesives and emulsions.

Figure 8:
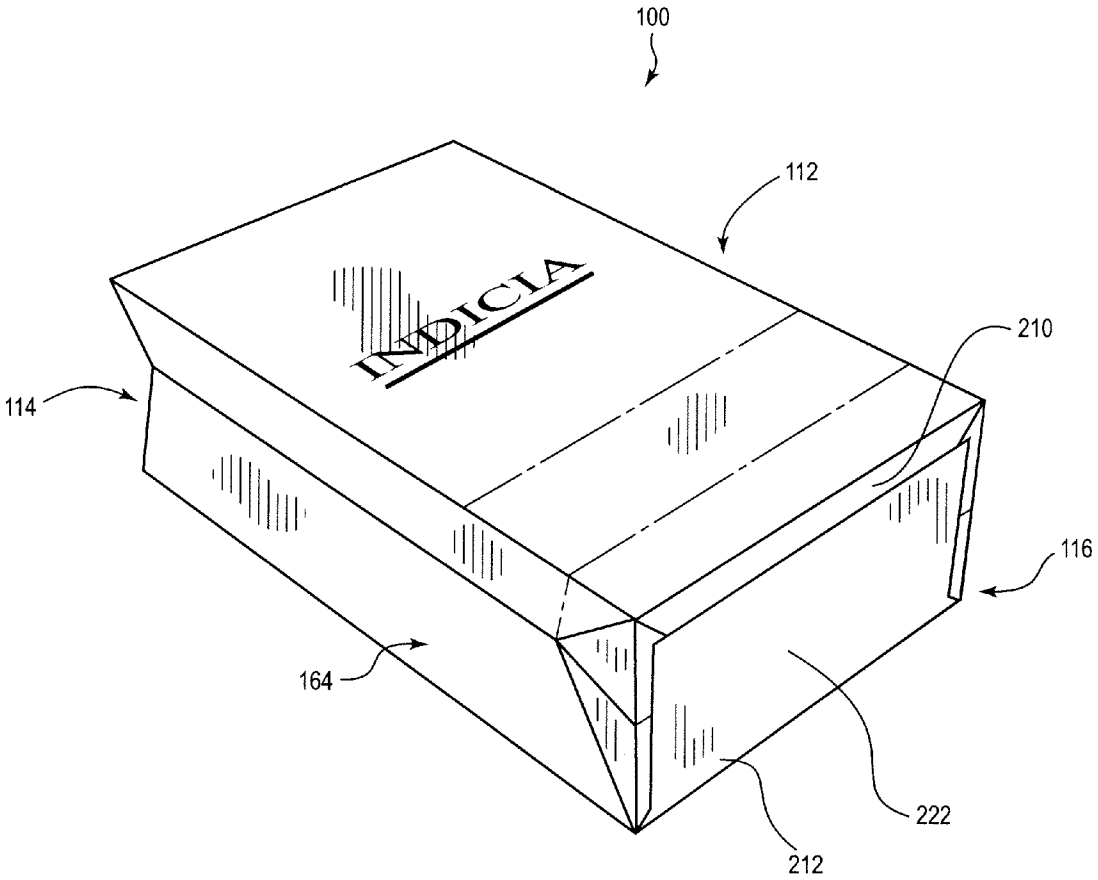
FIG. 8 is a perspective view of the body material of FIG. 3 in a further stage of bag formation.

With reference to FIGS. 6 and 8, in a further stage of assembly, the rear extension sub-panel 212 is folded inward and can be adhered to one or more of the front extension sub-panel 210, the left side extension sub-panel 214, and the right side extension sub-panel 216. For example, in the illustrated embodiment, the adhesive 250 is applied to the permeable regions 230*a*, 230*d* and the exposed portion of the permeable region 230*e*, and the rear extension sub-panel 212 is rotated toward the top end 114 of the tube 112. As a result, an outer surface of the inner flap 224, an inner surface of the outer flap 222, and an exposed outer surface of the inner ply 162 of the rear extension sub-panel 212 contact the adhesive-laden permeable regions 230*a*, 230*d*, 230*e*. Drying of the adhesive can proceed in a manner as described above with respect to FIGS. 6 and 7. In some embodiments, the small permeable regions 230*b*, 230*c* can sandwich the adhesive 250 relative to the permeable regions 230*a*, 230*d*, respectively. The permeable regions 230*b*, 230*c* thus can aid in drying the adhesive 250. In other embodiments, the permeable regions 230*b*, 230*c* can be omitted from the rear extension sub-panel 212.

In some embodiments, application of the adhesive 250 to two or more of the surfaces described above may take place in a single step, substantially simultaneously, or before folding of one or more portions of the extension panel 205. Moreover, other suitable folding techniques are known and may be used. In certain embodiments, the size, shape, spacing, and/or other configuration of the permeable regions can be adjusted according to changes in the folding patterns.

As shown in FIG. 8, in certain embodiments, the permeable regions 230 can be completely covered once the bottom end 112 of the bag 100 is closed. Stated otherwise, in some embodiments, when the bottom end 112 of the bag 100 is closed, the outermost surface of the bag 100 is devoid of permeable regions 230 such that the outermost surface comprises only substantially water-impervious portions of the outer ply 164. Accordingly, if the upper end 114 of the bag 100 is subsequently sealed in a substantially water-impervious manner, the entire bag 100 can be substantially water-impervious. Stated in yet another way, for some embodiments, the permeable regions 230 can be constrained to portions of the bag 100 where paper-to-paper contact and/or paper-to-paper liquid communication is achieved via the permeable regions 230.

In some embodiments, where the bag 100 has a sealed bottom end 112, the permeable regions 230 may be present only where paper layers and/or water-impervious portions of the outer ply 164 are at both sides of the permeable regions 230. For example, with reference again to FIG. 3, in some embodiments, an end portion of the sub-panel 210 can be devoid of the permeable region 230*e*, and this end portion can be sized to overlap the permeable region 230*f* of the inner salvage edge region 192. The outer salvage edge region 194 can be adhered to the inner salvage edge region 192 in such a manner that the seam 196 (see FIG. 1) is substantially water-impervious. Likewise, as shown in FIG. 8, the bottom end of the bag 100 can be sealed in a manner described above such that the outermost surface thereof is substantially water-impervious.

The top end 114 of the tube 112 can be closed in any suitable manner. For example, in some embodiments, the top end 114 is rolled downward and is sealed to an outer surface of the tube 112 via a hot melt adhesive. Stated otherwise, an outer surface of the top end 114 of the tube 112 can be sealed to an outer surface of a more medial portion of tube 112. In some embodiments, the top end 114 is sealed only after the adhesive 250 has dried. For example, for some embodiments, such as certain of the embodiments described above in which the outermost layer of a bag 100 that has a sealed bottom end 112 is substantially water-impervious, moisture is extracted from the wet adhesive 250 and is expelled from the bag 100 only via the open top end 114 of the bag 100; thus, the top end 114 of the bag 100 may desirably be sealed in a water-impervious manner only after the adhesive 250 has dried.

It will be understood by those having skill in the art that many changes may be made to the details of the above-described embodiments without departing from the underlying principles presented herein. Thus, the embodiments described herein should not be used to limit the scope of the following claims. Recitation in the claims of the term "first" with respect to a feature or element does not necessarily imply the existence of a second or additional such feature or element.

What is claimed is:

1. A bag comprising:

a body material comprising a first paper ply and a substantially water-impervious polyolefin layer outside of the first paper ply, wherein the body material defines a front wall, a rear wall, a first side wall extending between the front and rear walls, and a second side wall extending between the front and rear walls;

a front extension panel depending from the front wall, a rear extension panel depending from the rear wall, a first side extension panel depending from the first side wall, and a second side extension panel depending from the second side wall, wherein the extension panels are formed of the body material and are folded inward to define a base of the bag, wherein the polyolefin layer includes one or more permeable regions in each of the rear extension panel, the first side extension panel, and the second side extension panel, wherein each of said one or more permeable regions comprise one or more openings, and wherein said one or more permeable regions are constrained to the extension panels; and an adhesive attaching the rear extension panel to each of the first and second side extension panels, wherein a portion of the adhesive is between a permeable region of the rear extension panel and a permeable region of the first side extension panel, and wherein a portion of the adhesive is between a permeable region of the rear extension panel and a permeable region of the second side extension panel.

2. The bag of claim 1, wherein the polyolefin layer includes one or more permeable regions in the front extension panel, the bag further comprising an adhesive between permeable regions of the front extension panel and the first side extension panel and an adhesive between permeable regions of the front extension panel and the second side extension panel.

3. The bag of claim 2, wherein the rear extension panel includes a first flap and a second flap, wherein the first flap comprises a portion of the paper ply and is folded inwardly away from the polyolefin layer such that an inner surface of the paper ply faces itself, wherein the second flap comprises a portion of the polyolefin layer, and wherein an outer surface of the first flap and an inner surface of the second flap are adhered to an outer surface of the front extension panel.

4. The bag of claim 1, wherein the rear extension panel includes a first flap and a second flap, wherein the first flap comprises a portion of the paper ply and is folded inwardly away from the polyolefin layer such that an inner surface of the paper ply faces itself, wherein the second flap comprises a portion of the polyolefin layer, and wherein an outer surface of the first flap and an inner surface of the second flap are adhered to an outer surface of the front extension panel.

5. The bag of claim 1, wherein the adhesive comprises a water-based adhesive, and wherein the openings of the permeable regions are sufficiently large to permit water to pass through the openings so as to permit the adhesive to dry.

6. The bag of claim 5, wherein the openings of the permeable regions are sufficiently large to permit portions of the first paper ply to directly adhere to one another through the openings via the adhesive.

7. The bag of claim 1, wherein one or more of the one or more openings defines a maximum width of no more than about 1/16 of an inch.

8. The bag of claim 1, wherein the one or more openings are arranged in a repeating pattern.

9. The bag of claim 1, wherein a permeable region covers at least a portion of each of the extension panels.

10. The bag of claim 1, wherein permeable regions cover substantially all of the first and second side extension panels.

11. The bag of claim 1, wherein the rear extension panel includes a flap that comprises a portion of the polyolefin layer, wherein the flap is devoid of permeable regions, and wherein an inner surface of the flap is adhered to an outer surface of the front extension panel.

12. The bag of claim 1, wherein each of the one or more permeable regions extends from a bottom edge of an extension panel toward a bottom edge of the panel from which the extension panel depends by a distance of no less than about 1/4 the distance between said bottom edges.

13. The bag of claim 1, wherein the polyolefin layer is laminated to the first paper ply.

14. The bag of claim 13, wherein at least a portion of the polyolefin layer is reverse printed.

15. The bag of claim 1, further comprising a second paper ply between the polyolefin layer and the first paper ply.

16. The bag of claim 15, wherein the polyolefin layer is laminated to the second paper ply.

17. The bag of claim 16, wherein at least a portion of the polyolefin layer is reverse printed.

18. The bag of claim 16, wherein an outer surface of the second paper ply is printed.

19. The bag of claim 15, wherein only portions of the first and second paper plies are adhered to each other such that other portions of the first and second paper ply can shift relative to one another.

20. The bag of claim 15, wherein the permeable regions extend through both the polyolefin layer and the second paper ply.

21. The bag of claim 1, wherein the polyolefin layer comprises one or more of polyethylene terephalate, polypropylene, or nylon.

22. The bag of claim 1, wherein the adhesive comprises a water-based adhesive.

23. The bag of claim 1, wherein the adhesive comprises a starch-based adhesive.

24. The bag of claim 1, wherein the adhesive comprises an emulsion.

25. The bag of claim 1, further comprising a salvage edge panel that includes a permeable region.

26. A bag comprising:

a body material comprising a first paper ply and a substantially water-impervious layer outside of the first paper ply, wherein the body material defines a front wall, a rear wall, a first side wall extending between the front and rear walls, and a second side wall extending between the front and rear walls;

a first extension panel depending from at least one of the walls and comprising a portion of the body material, the first extension panel comprising a first permeable region that comprises one or more openings through the substantially water-impervious layer, and a second extension panel depending from another of the walls and comprising a portion of the body material, the second extension panel comprising a second permeable region that comprises one or more openings through the substantially water-impervious layer, wherein the first and second extension panels are folded relative to the walls from which they depend such that at least a portion of the substantially water-impervious layer of the first extension panel faces at least a portion of the substantially water-impervious layer of the second extension panel; and an adhesive attaching the first paper ply of the first extension panel to the first paper ply of the second extension panel, wherein the adhesive extends from the first paper ply of the first extension panel through the one or more openings in the first permeable region and further extends through the one or more openings in the second permeable region to the first paper ply of the second extension panel.

27. The bag of claim 26, wherein the substantially water-impervious layer comprises a polyolefin.

28. The bag of claim 26, wherein the substantially water-impervious layer comprises one or more of polyethylene terephalate, polypropylene, or nylon.

29. The bag of claim 26, further comprising a third extension panel that includes a first flap and a second flap, wherein the first flap comprises a portion of the paper ply and is folded inwardly away from the substantially water-impervious layer such that an inner surface of the paper ply faces itself, wherein the second flap comprises a portion of the substantially water-impervious layer, and wherein an outer surface of the first flap and an inner surface of the second flap are adhered to an outer surface of the first extension panel.

30. The bag of claim 26, wherein the adhesive comprises a water-based adhesive, and wherein the openings of the first and second permeable regions are sufficiently large to permit water to pass through the openings so as to permit the adhesive to dry.

31. The bag of claim 26, wherein one or more of the one or more openings defines a maximum width of no more than about 1/16 of an inch.

32. The bag of claim 26, wherein the one or more openings are arranged in a repeating pattern.

33. The bag of claim 26, further comprising a third extension panel depending from another of the walls, wherein the third extension panel includes a flap that comprises a portion of the substantially water-impervious layer, wherein the flap is devoid of permeable regions, and wherein an inner surface of the flap is adhered to an outer surface of first extension panel.

34. The bag of claim 26, wherein each of the first and second permeable regions extends from a bottom edge of an extension panel toward a bottom edge of the wall from which the extension panel depends by a distance of no less than about 1/4 the distance between said bottom edges.

35. The bag of claim 26, wherein the substantially water-impervious layer is laminated to the first paper ply.

36. The bag of claim 35, wherein at least a portion of the substantially water-impervious layer is reverse printed.

37. The bag of claim 26, further comprising a second paper ply between the substantially water-impervious layer and the first paper ply.

38. The bag of claim 37, wherein the substantially water-impervious layer is laminated to the second paper ply.

39. The bag of claim 38, wherein at least a portion of the substantially water-impervious layer is reverse printed.

40. The bag of claim 38, wherein an outer surface of the second paper ply is printed.

41. The bag of claim 37, wherein only portions of the first and second paper plies are adhered to each other such that other portions of the first and second paper plies can shift relative to one another.

42. The bag of claim 37, wherein the permeable regions extend through both the substantially water-impervious layer and the second paper ply.

43. The bag of claim 26, further comprising a salvage edge panel that includes a permeable region.

44. The bag of claim 26, wherein the adhesive comprises a water-based adhesive, a starch-based adhesive, or an emulsion.

45. The bag of claim 26, wherein the sole portion of the body material through which the adhesive extends is the one or more openings in the substantially water-impervious layer of the body material.

46. The bag of claim 26, wherein the adhesive extends from the first paper ply of the first extension panel through the one or more openings in the first permeable region, and further extends through the one or more openings in the second permeable region to the first paper ply of the second extension panel, without extending through any portion of the first paper ply of the body material.

47. The bag of claim 26, wherein the first and second extension panels are folded relative to the walls from which they depend such that at least a portion of the first paper ply of the first extension panel faces in a first direction and at least a portion of the first paper ply of the second extension panel faces in a second direction that is opposite of the first direction.

48. A bag comprising:

a body material comprising a first paper ply and a substantially water-impervious polyolefin layer outside of the first paper ply, wherein the body material defines a front wall, a rear wall, a first side wall extending between the front and rear walls, and a second side wall extending between the front and rear walls;

a first extension panel depending from at least one of the walls and comprising a portion of the body material and a second extension panel depending from another of the walls and comprising a portion of the body material, wherein each of the first and second extension panels comprises a permeable region that includes one or more openings through the substantially water-impervious layer, and wherein the first and second extension panels are folded relative to the walls from which they depend; and an adhesive positioned between the first and second extension panels, wherein the adhesive is in contact with the permeable region of the first extension panel and is in contact with the permeable region of the second extension panel, and wherein the permeable region of the first extension panel is positioned over the permeable region of the second extension panel.

49. The bag of claim 48, wherein the openings of the permeable regions are sufficiently large to permit portions of the first paper ply to directly adhere to one another through the openings via the adhesive.

50. The bag of claim 48, wherein one or more of the one or more openings defines a maximum width of no more than about 1/16 of an inch.

51. The bag of claim 48, wherein the one or more openings are arranged in a repeating pattern.

52. The bag of claim 48, wherein the permeable regions cover substantially all of the first and second extension panels.

53. The bag of claim 48, wherein each permeable region extends from a bottom edge of its extension panel toward a bottom edge of the panel from which the extension panel depends by a distance of no less than about 1/4 the distance between said bottom edges.

54. The bag of claim 48, wherein the polyolefin layer is laminated to the first paper ply.

55. The bag of claim 54, wherein at least a portion of the polyolefin layer is reverse printed.

56. The bag of claim 48, further comprising a second paper ply between the polyolefin layer and the first paper ply.

57. The bag of claim 56, wherein the polyolefin layer is laminated to the second paper ply.

58. The bag of claim 57, wherein at least a portion of the polyolefin layer is reverse printed.

59. The bag of claim 57, wherein an outer surface of the second paper ply is printed.

60. The bag of claim 56, wherein only portions of the first and second paper plies are adhered to each other such that other portions of the first and second paper plies can shift relative to one another.

61. The bag of claim 56, wherein the permeable regions extend through both the polyolefin layer and the second paper ply.

62. The bag of claim 48, wherein the polyolefin layer comprises one or more of polyethylene terephalate, polypropylene, or nylon.

63. The bag of claim 48, wherein the adhesive comprises a water-based adhesive, a starch-based adhesive, or an emulsion.

64. The bag of claim 48, further comprising a salvage edge panel that includes a permeable region.

65. The bag of claim 48, further comprising a third extension panel depending from another of the walls, wherein the third extension panel comprises a portion of the body material, wherein the third extension panel comprises a first flap and a second flap, wherein the first flap comprises a portion of the paper ply and is folded inwardly away from the substantially water-impervious layer such that an outer surface of the first flap faces away from the second flap, wherein the second flap comprises a portion of the substantially water-impervious layer, and wherein the outer surface of the first flap is adhered to the permeable region of the first extension panel.

* * * * *